US009957652B1

(12) United States Patent
Fouch et al.

(10) Patent No.: US 9,957,652 B1
(45) Date of Patent: May 1, 2018

(54) HAT STEAM CLEANER

(71) Applicants: Brent Fouch, San Diego, CA (US); Brad Steiner, Temecula, CA (US)

(72) Inventors: Brent Fouch, San Diego, CA (US); Brad Steiner, Temecula, CA (US)

( * ) Notice: Subject to any disclaimer, the term of this patent is extended or adjusted under 35 U.S.C. 154(b) by 0 days. days.

(21) Appl. No.: 15/221,468

(22) Filed: Jul. 27, 2016

(51) Int. Cl.

| | |
|---|---|
| ***D06F 18/00*** | (2006.01) |
| ***D06F 17/12*** | (2006.01) |
| ***D06F 58/10*** | (2006.01) |
| ***D06F 73/02*** | (2006.01) |
| ***D06F 87/00*** | (2006.01) |
| ***A42C 1/08*** | (2006.01) |
| ***A47L 25/00*** | (2006.01) |

(52) U.S. Cl.
CPC ..... *D06F 18/00* (2013.01); *A42C 1/08* (2013.01); *A47L 25/00* (2013.01); *D06F 17/12* (2013.01); *D06F 58/10* (2013.01); *D06F 73/02* (2013.01); *D06F 87/00* (2013.01)

(58) Field of Classification Search
CPC ..... D06F 18/00; D06F 17/12; D06F 58/10; D06F 73/02; D06F 87/00; A47L 25/00; A42C 1/08
See application file for complete search history.

(56) References Cited

U.S. PATENT DOCUMENTS

| | | | | |
|---|---|---|---|---|
| 1,889,761 | A * | 12/1932 | Schlesinger | A42C 1/08 134/86 |
| 3,672,188 | A * | 6/1972 | Geschka | D06F 17/04 68/12.15 |
| 5,418,996 | A * | 5/1995 | Chen | A47L 23/02 15/36 |
| 6,052,928 | A * | 4/2000 | Lin | A42C 1/08 223/21 |
| 8,317,933 | B2 * | 11/2012 | Bilias | B08B 1/04 134/22.1 |
| 2006/0112585 | A1 * | 6/2006 | Choi | D06F 29/005 34/73 |
| 2010/0251779 | A1 * | 10/2010 | Zaglio | A47G 25/20 68/13 R |
| 2010/0299952 | A1 * | 12/2010 | Hollinger | D06F 33/02 34/201 |
| 2010/0299976 | A1 * | 12/2010 | Roselle | D06F 33/02 38/1 A |
| 2012/0160269 | A1 * | 6/2012 | Pyo | D06F 58/203 134/18 |
| 2013/0104608 | A1 * | 5/2013 | Park | D06F 29/00 68/5 C |
| 2015/0000353 | A1 * | 1/2015 | Wang | D06F 18/00 68/5 C |
| 2016/0273152 | A1 * | 9/2016 | Farris | A43D 11/14 |

* cited by examiner

*Primary Examiner* — Joseph L. Perrin

(57) ABSTRACT

An apparatus for an improved manner for cleaning a hat by steam including a compartment for steam cleaning a baseball style hat and other style hats. The hat is placed on a hat mold and placed inside the compartment. Water is added to a water reservoir and heated by a heating element to convert the water to steam. Steam flows into the compartment and performs a cleaning operation on the hat.

15 Claims, 4 Drawing Sheets

HAT STEAM CLEANER

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of cleaning devices and more specifically relates to a hat steam cleaner.

2. Description of the Related Art

Hats and caps have long been a staple for wearing by people of all ages. They are used for utilitarian purpose to protect a head from weather elements and they are used to make all kinds of statements. Many people own several hats and have hats for all sorts of life experiences, including for athletic activities such as baseball and golf. As with many things that are worn outdoors, hats and caps may get dirty and rather than "retire" them, a person may want to clean them for future use. Consumers may elect to take their hats and caps to a dry cleaner, but that can be expensive. Some may wash them by hand, in a dishwasher, and in other ways. These methods often don't do cleaning job consumers desire.

Ideally, a hat steam cleaner should provide self-contained steam cleaning ability for a hat and, yet would operate reliably and be manufactured at a modest expense. Thus, a need exists for a reliable hat steam cleaner to avoid the above-mentioned problems.

BRIEF SUMMARY OF THE INVENTION

In view of the foregoing disadvantages inherent in the known cleaning device art, the present invention provides a novel hat steam cleaner. The general purpose of the present invention, which will be described subsequently in greater detail is to provide an improved manner for cleaning a hat by steam.

A hat steam cleaner adapted to clean a hat with steam and dry a hat via a plurality of fans in a closed compartment is disclosed herein, in a preferred embodiment, comprising a main structure formed as a hollow rectangular cuboid having a raised floor, a drain plug, and four rubber feet adapted to contain a hat for cleaning and drying, a hat mold having a main section and a pedestal, a water reservoir having a heating element with a timer adapted to heat water for conversion to stream, a plurality of steam distributors attached to a hollow tube formed of rubber having a first end and a plurality of distributor connectors, a plurality of fans adapted to dry a hat, a lid, an on-off switch, and an electric cord adapted to be plugged into an AC power source. Each of the main structure, the lid, the hat mold, and the water reservoir are formed of heat resistant plastic.

The main section of the hat mold, formed as a hollow dome shape, is adapted to hold a hat in position while being cleaned. The pedestal of the hat mold is fixedly molded to a bottom surface of the hollow dome shape. The hat mold is removeably placed on the raised floor of the main structure via the pedestal when the hat steam cleaner is in use. The raised floor is adapted to drain water onto a bottom interior surface of the main structure via a plurality of drain holes. The raised floor also keeps the hat mold holding the hat above dirty water accumulated on the bottom interior surface of the main structure during cleaning and drying.

The water reservoir, formed having a hollow rectangular cuboid and fixedly attached to an interior corner of the main structure, is adapted to hold water. The water reservoir includes a top opening adapted for a user to pour water into the water reservoir. The heating element, comprising an all points 1320 W heating element for 120V coffee brewers. is fixedly attached to an interior bottom surface of the water reservoir and is adapted to heat water for conversion to steam. The heating element includes a timer having a ten-minute wash cycle and a ten-minute dry cycle.

The steam distributors are adapted to deliver steam into the main structure. The steam distributors are attached to a hollow tube formed of rubber having a first end and a plurality of distributor connectors. The hollow tube is adapted to convey steam from the water reservoir to each of the plurality of steam distributors comprising a first steam distributor, a second steam distributor, a third steam distributor, a fourth steam distributor, a fifth steam distributor, and a sixth steam distributor. The plurality of distributor connectors comprises a first distributor connector, a second distributor connector, a third distributor connector, and a fourth distributor connector attached to the raised floor. The plurality of distributor connectors further comprises a fifth distributor connector and a sixth distributor connector attached to an interior surface of the lid.

The first distributor connector is connected to the first steam distributor via a first aperture. The second distributor connector is connected to the second steam distributor via a second aperture. The third distributor connector is connected to the third steam distributor via a third aperture. The fourth steam distributor connector is connected to the fourth steam distributor via a fourth aperture. The fifth distributor connector is connected to the fifth steam distributor via a fifth aperture. The sixth distributor connector is connected to the sixth steam distributor via a sixth aperture.

Each of the first steam distributor, second steam distributor, third steam distributor, fourth steam distributor, fifth steam distributor and sixth steam distributor is formed having a hollow bell shape with an opening adapted to allow steam to disperse into the main structure and an aperture for connection to the first distributor connector, the second distributor connector, the third distributor connector, the fourth distributor connector, the fifth distributor connector and the sixth distributor connector respectively.

The plurality of fans adapted to dry a hat includes a first fan, a second fan, a third fan, and a fourth fan. The first fan and the second fan are attached to the raised floor. The third fan and the fourth fan are attached to an interior surface of the lid. The drying process is accomplished via two fans positioned below the hat and two fans positioned above the hat.

The drain plug is removable from a drain plug hole located on the main structure. The drain plug hole is adapted to drain water from the main structure upon completion of cleaning a hat. Each of the four rubber feet are located on a first corner, a second corner, a third corner, and a fourth corner of a bottom exterior surface of the main structure.

The lid is adapted to retain steam within the main structure. The lid includes a handle adapted to manipulate the main structure when the lid is secured to the main section and an on-off switch adapted to activate and deactivate a cleaning and drying cycle. The cleaning cycle includes a 10-minute wash cycle and a 10-minute dry cycle controlled by the timer attached to the heating element. The lid having a concave shape adapted to close around the main portion of the hat is fixedly attached to the main structure via a first hinge attached at a first hinge location and a second hinge attached at a second hinge location. The lid opens and closes in relation to the main structure via the first hinge and the second hinge.

The on-off switch formed as a rocker switch is adapted to activate the heating element. The on-off switch, when in an on position, activates the cleaning cycle and when in the off position, deactivates the cleaning cycle. During the course of the cleaning cycle the timer initiates the wash cycle and the dry cycle appropriately.

The electric cord includes a first end adapted to be connected to the heating element at a cord connection location on the heating element and a second end adapted to be plugged into an AC power source to provide power to the heating element.

The present invention holds significant improvements and serves as a hat steam cleaner. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a hat steam cleaner constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to cleaning device art and more particularly to a hat steam cleaner as used to provide an improved manner for cleaning a hat by steam.

Generally speaking, a hat steam cleaner is a compartment for steam cleaning and drying a baseball style hat. The hat is placed on a hat mold and placed inside the compartment. Water is added to a water reservoir and heated by a heating element to convert the water to steam. Steam flows into the compartment and performs a cleaning operation on the hat. The washing cycle of cleaning the hat is controlled via a timer which then transitions into a drying cycle.

Figure 1:
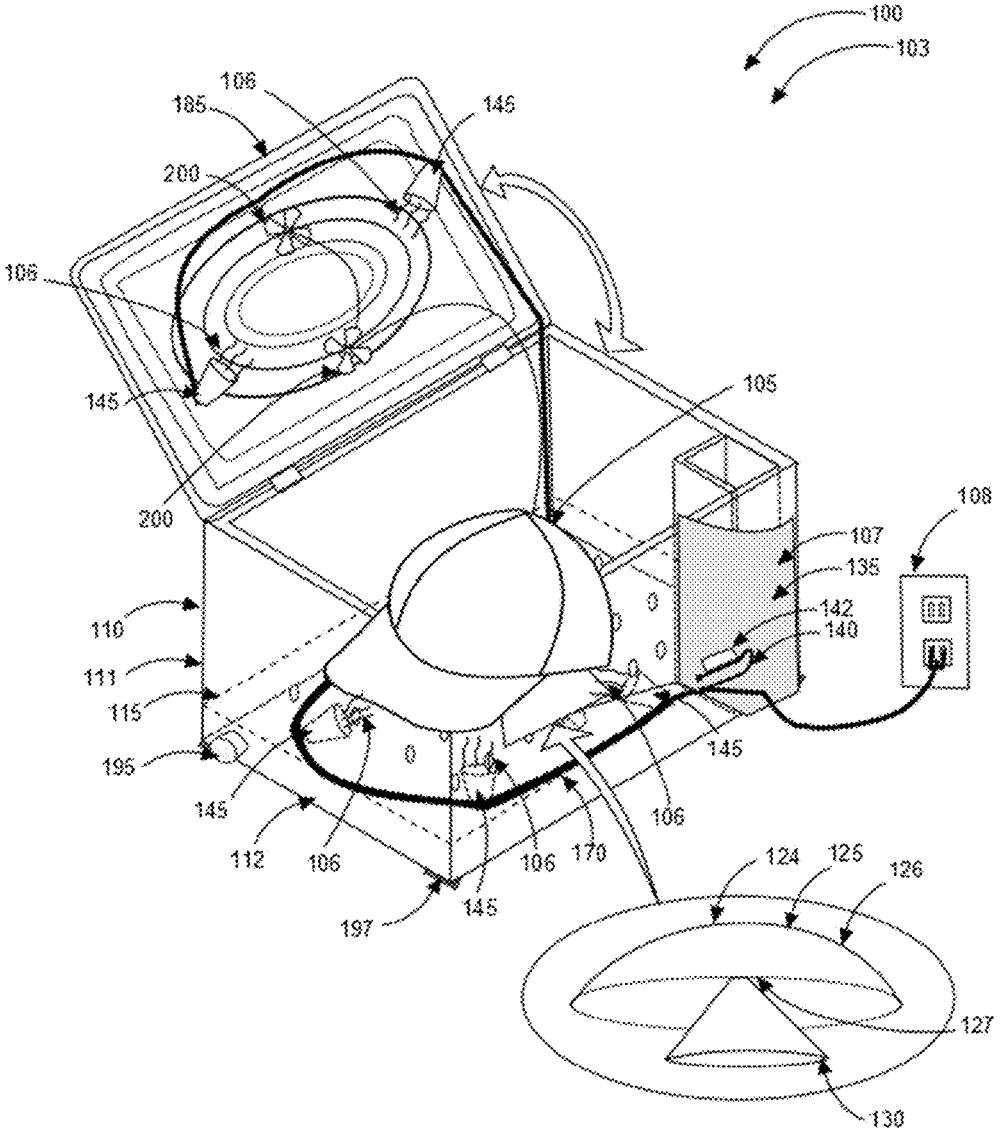
FIG. 1 shows a perspective view illustrating a hat steam cleaner in an in use condition according to an embodiment of the present invention.

Referring to the drawings by numerals of reference there is shown in FIG. 1, a perspective view illustrating hat steam cleaner 100 in an in use condition 103 according to an embodiment of the present invention.

Hat steam cleaner 100 adapted to clean hat 105 with steam 106 and dry hat 105 via plurality of fans 200 in a closed compartment is disclosed herein, in a preferred embodiment, comprising main structure 110 formed as a hollow rectangular cuboid 111 having raised floor 115, drain plug 195, and four rubber feet 197 adapted to contain hat 105 for cleaning and drying, hat mold 124 having main section 125 and pedestal 130, water reservoir 135 having heating element 140 with timer 142, plurality of steam distributors 145 attached to hollow tube 170 formed of rubber having first end 172 and plurality of distributor connectors 174, plurality of fans 200, lid 185, on-off switch 188, and electric cord 189 adapted to be plugged into an AC power source 108. Each of main structure 110, lid 185, hat mold 124, and water reservoir 135 are formed of heat resistant plastic. Alternately, main structure 110, lid 185, hat mold 124, and water reservoir 135 may be formed of any suitable material. Hat 105 may be a baseball or golf style cap, or it may be any form of hat, cap, or other headwear.

Figure 2:
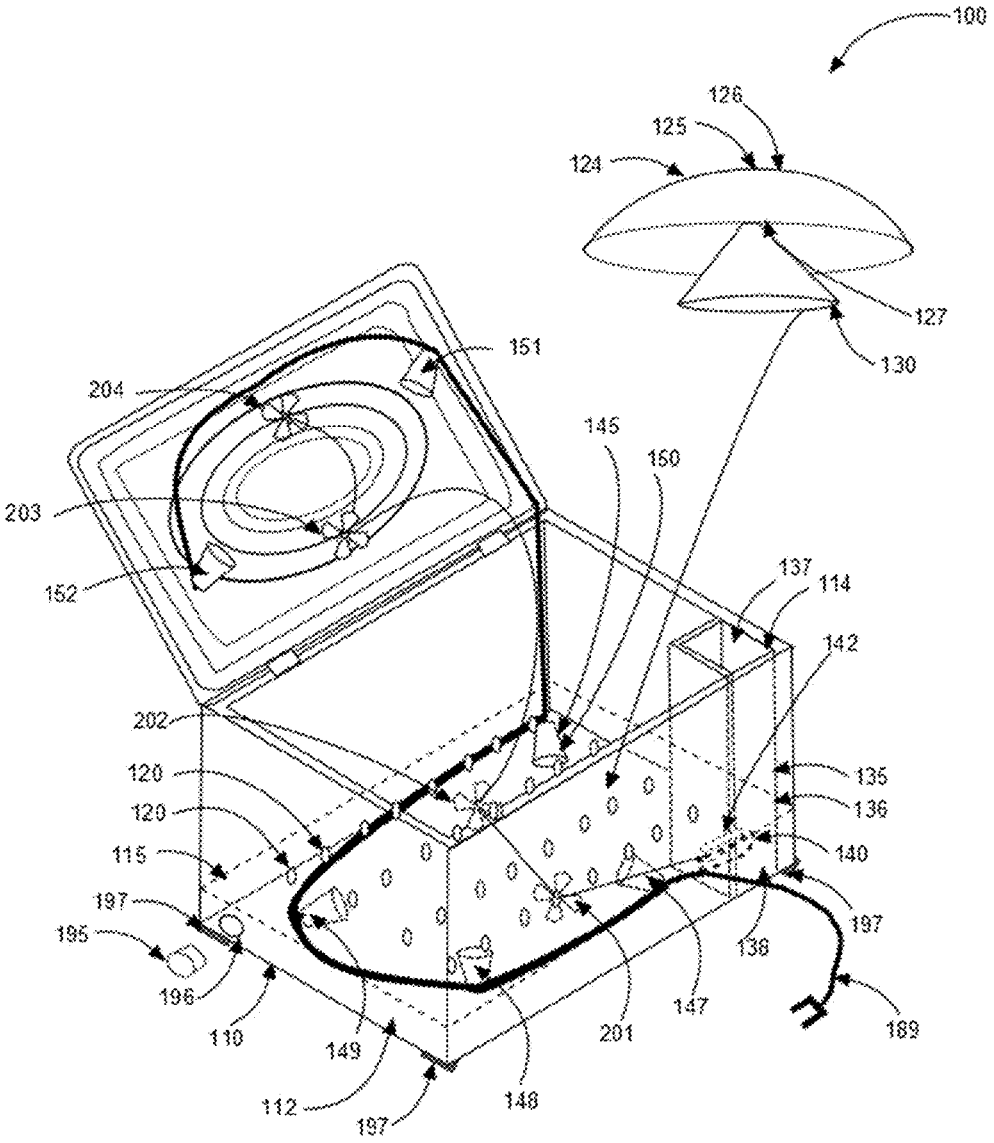
FIG. 2 is a perspective view illustrating a hat steam cleaner according to an embodiment of the present invention of FIG. 1.

Referring now to FIG. 2, a perspective view illustrating hat steam cleaner 100 according to an embodiment of the present invention of FIG. 1.

Main section 125 of hat mold 124, formed as a hollow dome shape 126, is adapted to hold hat 105 in position while being cleaned and dried. Pedestal 130 of hat mold 124 is fixedly molded to bottom surface 127 of hollow dome shape 126. Hat mold 124 is removeably placed on raised floor 115 of main structure 110 via pedestal 130 when hat steam cleaner 100 is in use. Raised floor 115 is adapted to drain water 107 onto bottom interior surface 112 of main structure 110 via plurality of water drain holes 120. Raised floor 115 also keeps hat mold 124 holding hat 105 above dirty water 107 accumulated on bottom interior surface 112 of main structure 110 during cleaning and drying.

Water reservoir 135, formed having hollow rectangular cuboid shape 136 and fixedly attached to interior corner 114 of main structure 110, is adapted to hold water 107. Water reservoir 135 includes top opening 137 adapted for a user to pour water 107 into water reservoir 135. Heating element 140, comprising an all points 1320 W heating element for 120V coffee brewers, is fixedly attached to interior bottom surface 138 of water reservoir 135, and is adapted to heat water 107 for conversion to steam 106. Heating element 140 includes timer 142 having a ten-minute wash cycle and a ten-minute dry cycle.

Figure 3:
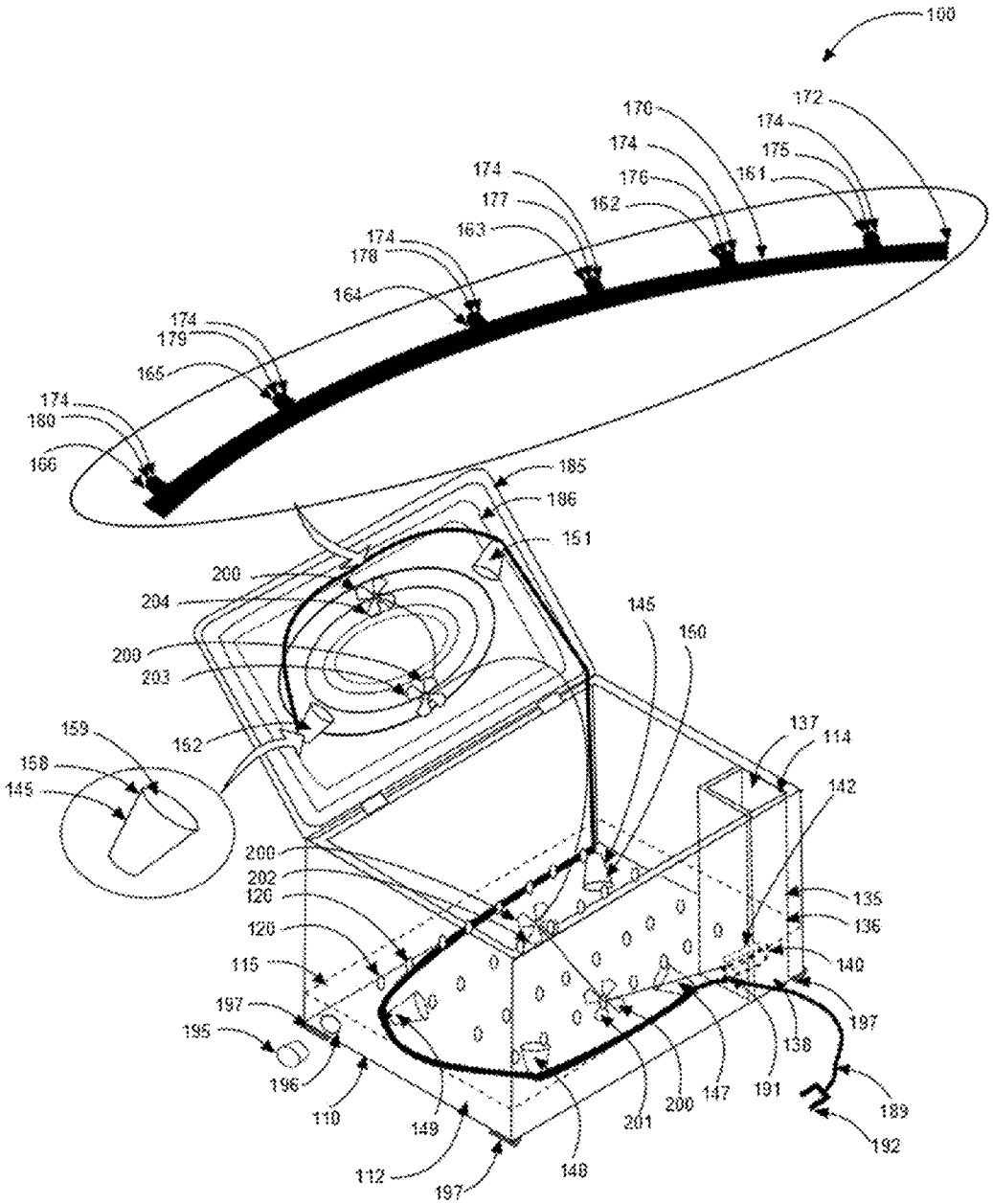
FIG. 3 is a perspective view illustrating a hat steam cleaner according to an embodiment of the present invention of FIG. 1.

Referring now to FIG. 3, a perspective view illustrating hat steam cleaner 100 according to an embodiment of the present invention of FIG. 1.

Plurality of steam distributors 145 are adapted to deliver steam 106 into main structure 110. Each of plurality of steam distributors 145 are attached to hollow tube 170 formed of rubber having first end 172 and plurality of distributor connectors 174. Hollow tube 170 is adapted to convey steam 106 from water reservoir 135 to each of plurality of steam distributors 145 comprising first steam distributor 147, second steam distributor 148, third steam distributor 149, fourth steam distributor 150, fifth steam distributor 151, and sixth steam distributor 152. Plurality of distributor connectors 174 comprises first distributor connector 175, second distributor connector 176, third distributor connector 177, and fourth distributor connector 178 attached to raised floor 115. Plurality of distributor connectors further comprises fifth distributor connector 179 and sixth distributor connector 180 attached to interior surface 186 of lid 185.

First distributor connector 175 is connected to first steam distributor 147 via first aperture 161. Second distributor connector 176 is connected to second steam distributor 148 via second aperture 162. Third distributor connector 177 is connected to third steam distributor 149 via third aperture 163. Fourth distributor connector 178 is connected to fourth steam distributor 150 via fourth aperture 164. Fifth distributor connector 179 is connected to fifth steam distributor 151 via fifth aperture 165. Sixth distributor connector 180 is connected to sixth steam distributor 152 via sixth aperture 166.

Each of first steam distributor 147, second steam distributor 148, third steam distributor 149 and fourth steam distributor 150, fifth steam distributor 151 and sixth steam distributor 152 is formed having hollow bell shape 158 with opening 159 adapted to allow steam 106 to disperse into main structure 110 and aperture 160 for connection to first distributor connector 175, second distributor connector 176, the distributor connector 177, fourth distributor connector 178, fifth distributor connector 179 and sixth distributor connector 180 respectively.

Plurality of fans 200 adapted to dry hat 105 includes first fan 201, second fan 202, third fan 203, and fourth fan 204. First fan 201 and second fan 202 are attached to raised floor 115. Third fan 203 and fourth fan 204 are attached to interior surface 186 of lid 185. The drying process is accomplished via two fans of plurality of fans 200 positioned below hat 105 and two fans of plurality of fans 200 positioned above hat 105. Each of first fan 201, second fan 202, third fan 203, and fourth fan 204 receive energy via electric cord 189.

Drain plug 195 is removable from drain plug hole 196 located on main structure 110. Drain plug hole 196 is adapted to drain water 107 from main structure 110 upon completion of cleaning hat 105. Each of four rubber feet 197 are located on the four corners of bottom exterior surface 121 of main structure 110.

Figure 4:
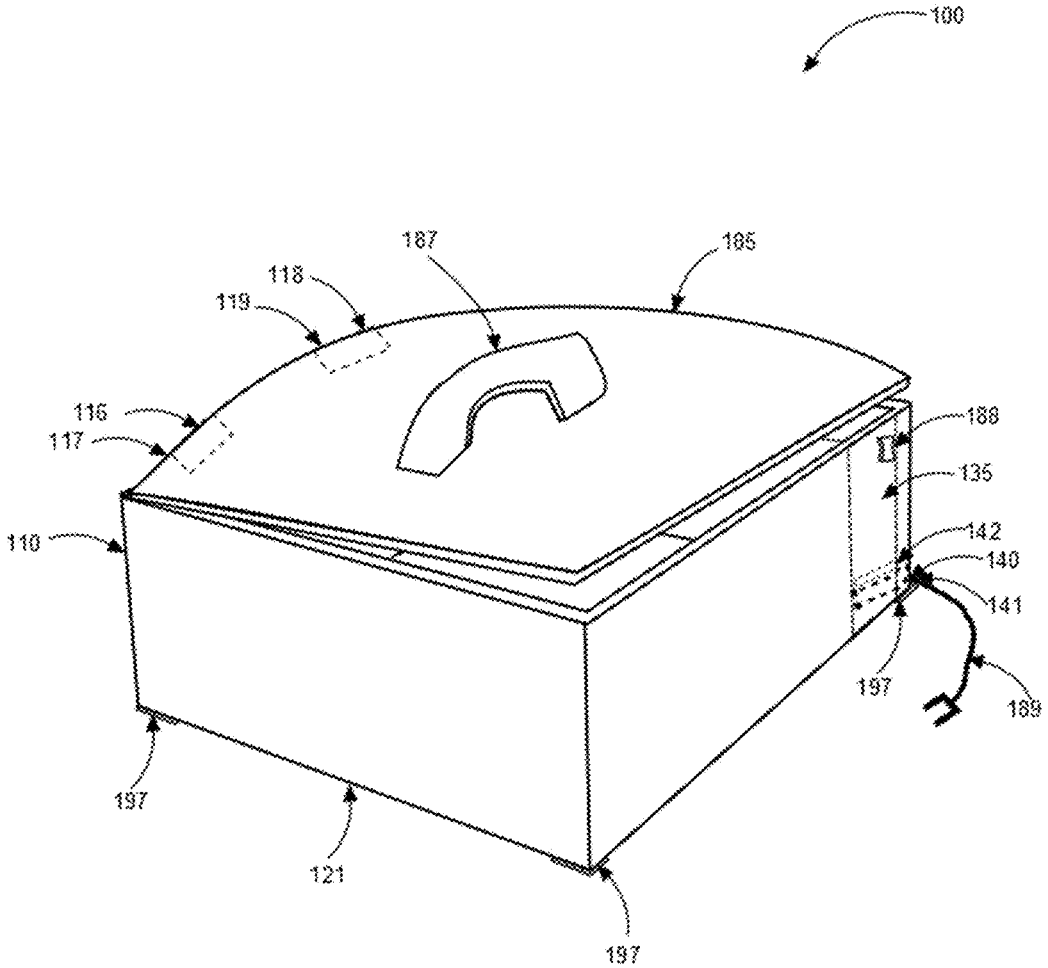
FIG. 4 is a perspective view illustrating a hat steam cleaner according to an embodiment of the present invention of FIG. 1.

Referring now to FIG. 4, a perspective view illustrating hat steam cleaner 100 according to an embodiment of the present invention of FIG. 1.

Lid 185 is adapted to retain steam 106 within main structure 110. Lid 185 includes handle 187 adapted to manipulate main structure 110 when lid 185 is secured to main section 110 and on-off switch 188 adapted to activate and deactivate a cleaning and drying cycle. The cleaning cycle includes a 10-minute wash cycle and a 10-minute dry cycle controlled by timer 142 attached to heating element 140. Lid 185 having a concave shape adapted to close around the main portion of cap 105 is fixedly attached to main structure 110 via first hinge 116 attached at first hinge location 117 and second hinge 118 attached at second hinge location 119. Lid 185 opens and closes in relation to main structure 110 via first hinge 116 and second hinge 118.

On-off switch 188, formed as a rocker switch, is adapted to activate heating element 140. On-off switch 188, when in an on position, activates the cleaning cycle and when in the off position, deactivates the cleaning cycle. During the course of the cleaning cycle, timer 142 initiates the wash cycle and the dry cycle appropriately.

Electric cord 189 includes first end 191 adapted to be connected to heating element 140 at cord connection location 141 on heating element 140 and second end 192 adapted to be plugged into AC power source 108 to provide power to heating element 140. Electric cord 189 further provides energy to plurality of fans 200.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A hat steam cleaner adapted to clean a hat with steam and dry said hat in a closed compartment comprising:

a main structure having a raised floor, a drain plug, and four rubber feet, said main structure adapted to contain said hat for cleaning;

a hat mold having a main section and a pedestal adapted to hold said hat in position;

a water reservoir adapted to hold water having a heating element adapted to heat said water for conversion to steam;

wherein said hat mold is removeably placed on said raised floor of said main structure via said pedestal, said raised floor adapted to drain water onto a bottom interior surface of said main structure via a plurality of drain holes and to keep said hat mold holding said hat above dirty said water accumulated on said bottom interior surface of said main structure during cleaning;

wherein said water reservoir is fixedly attached to an interior corner of said main structure; and wherein said heating element is fixedly attached to an interior bottom surface of said water reservoir;

wherein said drain plug is removed from a drain plug hole located on said main structure, said drain plug hole adapted to drain said water from said main structure upon completion of cleaning said hat;

wherein each of said four rubber feet are located on a first corner, a second corner, a third corner, and a fourth corner of a bottom exterior surface of said main structure;

a plurality of steam distributors adapted to deliver said steam into said main structure attached to a hollow tube having a first end and a plurality of distributor connectors, said hollow tube adapted to convey steam from said water reservoir to each of said plurality of steam distributors;

a plurality of fans adapted to dry said hats;

wherein said plurality of steam distributors comprises a first steam distributor, a second steam distributor, a third steam distributor, a fourth steam distributor, a fifth steam distributor, and a sixth steam distributor;

wherein said plurality of distributor connectors comprises a first distributor connector, a second distributor connector, a third distributor connector, a fourth distributor connector, a fifth distributor connector, and a sixth distributor connector;

wherein said first distributor connector is connected to said first steam distributor via a first aperture, said second distributor connector is connected to said second steam distributor via a second aperture, said third distributor connector is connected to said third steam distributor via a third aperture, said fourth distributor connector is connected to said fourth steam distributor via a fourth aperture, said fifth distributor connector is connected to said fifth steam distributor via a fifth aperture, said sixth distributor connector is connected to said sixth steam distributor via a sixth aperture;

wherein said fans comprise a first fan, a second fan, a third fan, and a fourth fan;

a lid having a handle adapted to manipulate said main structure and an on-off switch adapted to activate and deactivate a cleaning cycle, said lid adapted to retain said steam within said main structure;

wherein said lid is fixedly attached to said main structure via a first hinge attached at a first hinge location and a second hinge attached at a second hinge location;

wherein said lid includes a concave shape adapted to close around the main portion of said hat;

wherein said lid opens and closes in relation to said main structure via said first hinge and said second hinge; and wherein said cleaning cycle includes a wash cycle and a dry cycle, said wash cycle and said dry cycle controlled by a timer attached to said heating element; and an electric cord having a first end adapted to be connected to said heating element at a cord connection location on said heating element and a second end adapted to be plugged into an AC power source to provide power to said heating element.

2. The hat steam cleaner of claim 1 wherein each of said main structure, said lid, said hat mold, and said water reservoir are formed of heat resistant plastic.

3. The hat steam cleaner of claim 1 wherein said main structure is formed as a hollow rectangular cuboid.

4. The hat steam cleaner of claim 1 wherein said main section of said hat mold is formed having a hollow dome shape.

5. The hat steam cleaner of claim 1 wherein said pedestal of said hat mold is fixedly molded to a bottom surface of said hollow dome shape.

6. The hat steam cleaner of claim 1 wherein said water reservoir is formed having a hollow rectangular cuboid, said water reservoir having a top opening adapted for a user to pour water into said water reservoir.

7. The hat steam cleaner of claim 1 wherein each of said first steam distributor, said second steam distributor, said third steam distributor, said fourth steam distributor, said fifth steam distributor, and said sixth steam distributor is formed having a hollow bell shape, each of said hollow bell shape having an opening adapted to allow said steam to disperse into said main structure and an aperture for connection to said first distributor connector, said second distributor connector, said third distributor connector, said fourth distributor connector, said fifth distributor connector, and said sixth distributor connector connector respectively.

8. The hat steam cleaner of claim 1 wherein each of said first distributor connector, said second distributor connector, said third distributor connector, and said fourth distributor connector are attached to said raised floor.

9. The hat steam cleaner of claim 1 wherein each of said fifth distributor connector and said sixth distributor connector are attached to an interior surface of said lid.

10. The hat steam cleaner of claim 1 wherein said first fan and said second fan are attached to said raised floor.

11. The hat steam cleaner of claim 1 wherein said third fan and said fourth fan are attached to said interior surface of said lid.

12. The hat steam cleaner of claim 1 wherein said hollow tube is formed of rubber.

13. The hat steam cleaner of claim 1 wherein said on on-off switch comprises a rocker switch.

14. The hat steam cleaner of claim 1 wherein said timer includes a ten minute said wash cycle and a ten minute said dry cycle.

15. The hat steam cleaner of claim 1 wherein said heating element comprises an all points 1320 W heating element for 120V coffee brewers.

* * * * *